US012590445B2

(12) United States Patent
Niederlander

(10) Patent No.: US 12,590,445 B2
(45) Date of Patent: Mar. 31, 2026

(54) FAUCET INSTALLATION ASSEMBLIES AND METHODS OF INSTALLING THE SAME

(71) Applicant: Kohler Co., Kohler, WI (US)

(72) Inventor: Gabriel Maclean Niederlander, Wauwatosa, WI (US)

(73) Assignee: Kohler Co., Kohler, WI (US)

( * ) Notice: Subject to any disclaimer, the term of this patent is extended or adjusted under 35 U.S.C. 154(b) by 158 days.

(21) Appl. No.: 18/481,598

(22) Filed: Oct. 5, 2023

(65) Prior Publication Data

US 2024/0117613 A1 Apr. 11, 2024

Related U.S. Application Data

(60) Provisional application No. 63/378,622, filed on Oct. 6, 2022.

(51) Int. Cl.
*E03C 1/04* (2006.01)

(52) U.S. Cl.
CPC ..... *E03C 1/0401* (2013.01)

(58) Field of Classification Search
CPC ..... E03C 1/0401; E03C 1/0402; E03C 2001/0416
See application file for complete search history.

(56) References Cited

U.S. PATENT DOCUMENTS

| | | | | |
|---|---|---|---|---|
| 5,375,272 | A | 12/1994 | Mikol | |
| 6,405,749 | B1 | 6/2002 | Bloom et al. | |
| 6,421,849 | B1 * | 7/2002 | Gray | E03C 1/0402 4/675 |
| 6,631,730 | B1 | 10/2003 | Bloom et al. | |
| 6,678,903 | B1 | 1/2004 | Rhodes | |
| 6,807,692 | B2 | 10/2004 | Tsutsui et al. | |
| 6,874,527 | B2 | 4/2005 | Meeder | |
| 8,231,318 | B2 | 7/2012 | Pitsch et al. | |
| 9,243,388 | B2 * | 1/2016 | Sansum | E03C 1/04 |
| 9,487,936 | B2 | 11/2016 | Sallah | |
| 10,030,370 | B1 | 7/2018 | Xiao et al. | |
| 10,683,646 | B2 | 6/2020 | Pei et al. | |
| 11,136,749 | B2 * | 10/2021 | Shen | E03C 1/0402 |
| 11,242,674 | B2 | 2/2022 | Chen et al. | |
| 2006/0193712 | A1 | 8/2006 | Kuna et al. | |

FOREIGN PATENT DOCUMENTS

| | | | | |
|---|---|---|---|---|
| CN | 113622484 | A * | 11/2021 | E03C 1/0401 |
| EP | 3530822 | A4 | 8/2019 | |
| JP | H0893012 | A * | 4/1996 | E03C 1/0402 |
| JP | H10102556 | A * | 4/1998 | E03C 1/0402 |
| JP | 2000282525 | A * | 10/2000 | |
| WO | WO-02068763 | A1 * | 9/2002 | E03C 1/0402 |

* cited by examiner

*Primary Examiner* — Erin Deery
(74) *Attorney, Agent, or Firm* — Husch Blackwell LLP

(57) ABSTRACT

The faucet installation assemblies can include flexible stems that can be movably aligned with an aperture in order to install a faucet body onto a deck without the need to install the hardware under the deck. A faucet installation assembly can include an anchoring component including a crushable anchor with a plurality of flexible stems extending axially from the anchor, and a gasket, locator/locker washers, threaded washer, and a collar that are coupled to and movable along the plurality of flexible stems. Another faucet assembly can include at least a shank nut and a plurality of shank stems coupled at a first end forming a collar, each shank stem having a free end extending radially and axially from the collar.

10 Claims, 14 Drawing Sheets

FAUCET INSTALLATION ASSEMBLIES AND METHODS OF INSTALLING THE SAME

CROSS-REFERENCE TO RELATED APPLICATIONS

The present application claims the benefit and priority of U.S. Provisional Application No. 63/378,622, filed Oct. 6, 2022, which is hereby incorporated by reference.

BACKGROUND

The present disclosure related generally to faucet installation. More specifically, the present disclosure relates to installation components that include segments to affix faucet hardware to a desired location on a deck or countertop in a limited number of steps and without the need to access below the deck.

SUMMARY

An example of a faucet installation assembly can include an anchoring component including a crushable anchor, such as a circular base, with a plurality of flexible stems extending axially from the base, and elements for fixing a faucet body to the countertop, the elements including a gasket, locator/locker washers, threaded washer, and a collar that are threaded or otherwise coupled to and movable along the plurality of flexible stems in that order. The collar can include interlocking threads that correspond to internal threads of a faucet body such that when the faucet body is positioned on and over the collar and rotated in a first direction, the faucet body can be secured or locked to the collar. When the faucet body is rotated in a second, opposite direction, the faucet body can be unlocked from the collar.

In this example, to install the assembly, the base of the anchoring component is pinched and pushed through an aperture formed in the deck such that the flexible stems extend upwardly through the aperture. The gasket and locater washer are moved down until the gasket is flush with the top of the deck. Once the gasket and locator washer are centered, the flexible stems are pulled up, and the collar is pushed or ratcheted down to sandwich gasket and washers between the top of the deck and the collar. The collar is rotated until set screws extending through the elements are seated into corresponding locator points in the locator washer, and then the screws are tightened to secure the elements to the deck. The stems can optionally be trimmed. The faucet body is then secured over the collar and rotated to lock the faucet body in place on the deck. The faucet body can be rotated in the opposite direction to remove the faucet body for repair or to be replaced. In this example, the installation assembly requires minimal access below the deck to connect water supply lines the faucet, and optionally a pull-down hose and corresponding weight of a pull-down faucet. In an alternative embodiment, the flexible stems are substituted for fasteners, such as machine screw fasteners, on which one or more of the elements are engaged, such as by threading engagement.

Another example of the present disclosure relates to a faucet installation assembly including a shank subassembly comprising a shank nut coupled to a collar having a plurality of flexible, stepped shank stems extending radially and vertically below the collar. In this example, to install the assembly, the shank stems are pinched inwardly and inserted into an aperture formed into the deck until the shank nut is flush with the deck. A set of steps of the shank stems overlap a distal edge of the aperture on the bottom surface of the deck (i.e., below the deck), securing the faucet installation assembly into the aperture so that the shank nut is flush with the top surface of the deck. The faucet body is secured to the shank nut as in the previous example.

The summary above is not intended to describe each illustrated example or every implementation of the present disclosure. The figures and the detailed description that follow more particularly exemplify these implementations.

BRIEF DESCRIPTION OF THE DRAWINGS

The disclosure can be more completely understood in consideration of the following detailed description of various examples of the disclosure, in connection with the accompanying drawings, in which.

Figure 1:
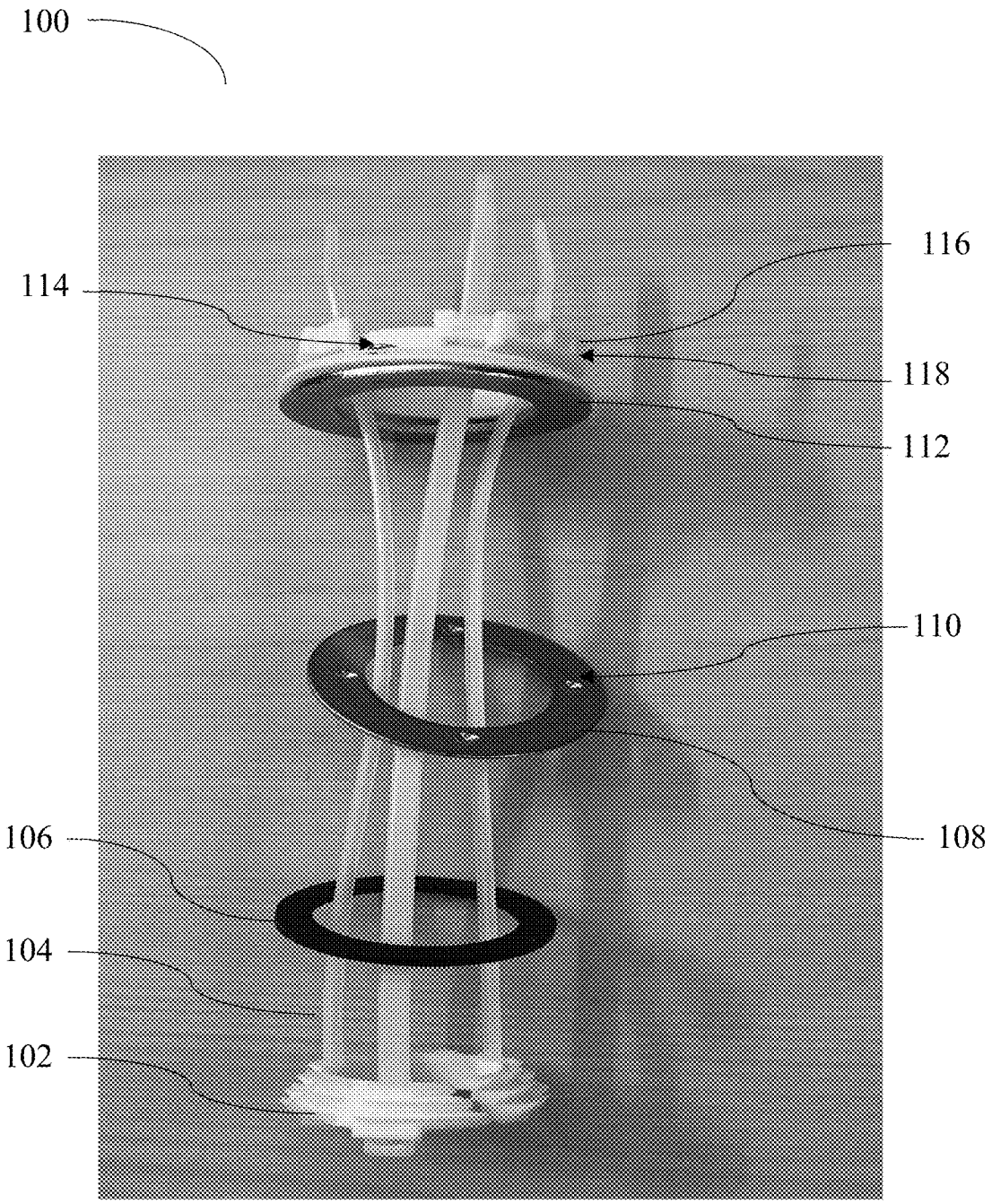
FIG. 1 is a perspective view of an example of a faucet installation assembly with elements in an expanded assembled position.

While examples of the disclosure are amenable to various modifications and alternative forms, specifics thereof shown by way of example in the drawings will be described in detail. It should be understood, however, that the intention is not to limit the disclosure to the particular examples described. On the contrary, the intention is to cover all modifications, equivalents, and alternatives falling within the spirit and scope of the subject matter as defined by the claims.

DETAILED DESCRIPTION

Referring generally to the FIGURES, disclosed herein are examples of faucet installation assemblies that install a faucet body into a desired location on a countertop. The installation assemblies of the present disclosure advantageously limit the number of parts and steps required to install a faucet body, and reduce the need to install components under the countertop or deck. The faucet body can be affixed to the desired aperture via the faucet installation assembly with no additional fastenings. The installation assemblies of this applicant can facilitate an efficient installation relative to other methods of installation wherein the parts required are of separate examples and require additional fastenings.

According to an exemplary embodiment, a faucet installation assembly can include an anchor that can be installed into an aperture at the desired location of the faucet, with the other elements of the assembly movably connected to the anchor with flexible stems.

According to another exemplary embodiment, one faucet installation assembly can include stepped stems that, when inserted into an aperture at the desired location of the faucet, secure the assembly into the aperture. The faucet body can be affixed to the assembly after the assembly has been installed into the aperture.

Figure 2:
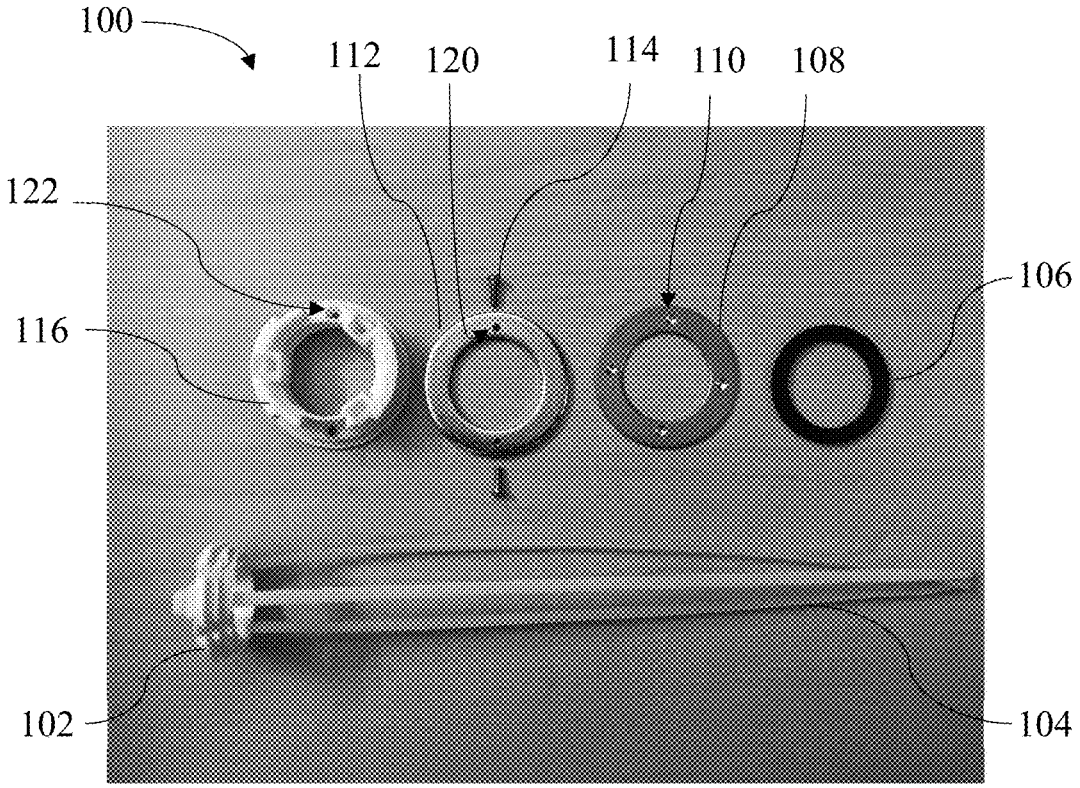
FIG. 2 is a perspective view of an example of a faucet installation assembly with elements in an exploded unassembled position.

FIG. 1 illustrates an example of a faucet installation assembly 100, shown configured for use, while FIG. 2 illustrates faucet installation assembly 100, shown in a disassembled use. Faucet installation assembly 100 includes an anchor 102, having a plurality of flexible stems 104. A gasket 106, a locator/locker washer 108, a threaded washer 112, and a collar 116 can be ring-shaped, with an opening originating in the center of each component; however other shapes can be considered. The gasket 106, the locator/locker washer 108, the threaded washer 112, and the collar 116 can be movably fitted around the plurality of flexible stems 104. The anchor 102 serves as the first installation piece. The other elements can be ordered as followed: the gasket 106, the locator/locker washer 108, the threaded washer, and the collar 116.

In a non-limiting example, to install faucet installation assembly, an aperture 402 in a deck 400 is located in the desired location of the faucet body 200 after installation. Exemplified in FIG. 3A, the anchor 102 can be fit securely inside the aperture 402 by pinching the anchor 102 to compress it. During installation, the gasket 106, the locator/locker washer 108, the threaded washer 112, and the collar 116 are movable along the flexible stems 104 toward the deck 400. These components can be moved into their functional location by pushing downward on the collar 116 and pulling upward on the plurality of flexible stems 104.

In various non-limiting examples, the threaded washer 112 has a plurality of washer holes 120 that can fit a plurality of screws 114. The plurality of screws 114 can secure the threaded washer to collar 116 by threading through the plurality of collar holes 122 into the plurality of washer holes 120. Referring back to FIG. 2, FIG. 2 exemplifies one possible arrangement and number of the washer holes 120, the collar holes 122, and the plurality of screws 114; however any of a number of arrangements can be contemplated.

Figure 3A:
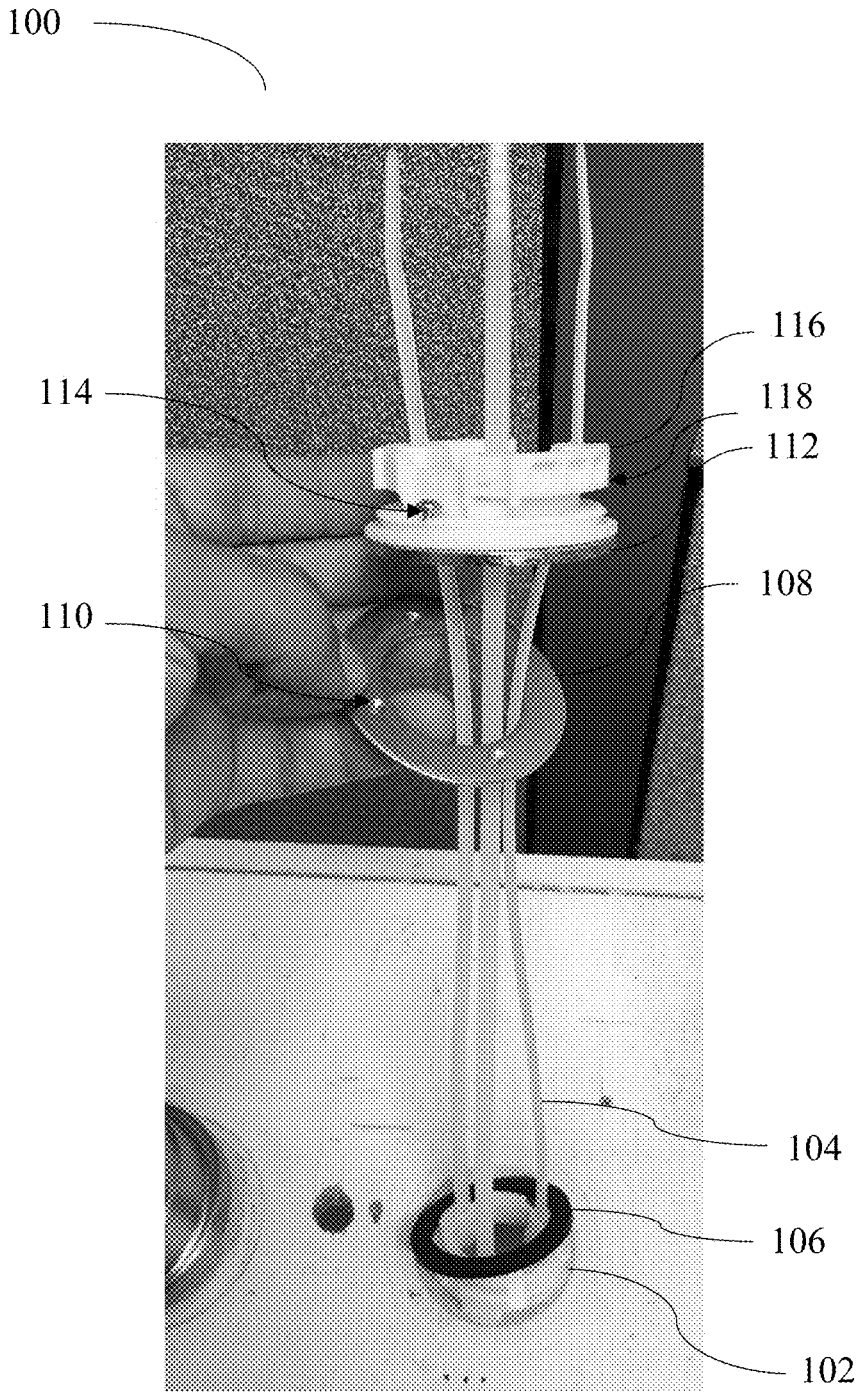
FIGS. 3A-3C are perspective views of an example of a faucet installation assembly in various installation positions.
Figure 3B:
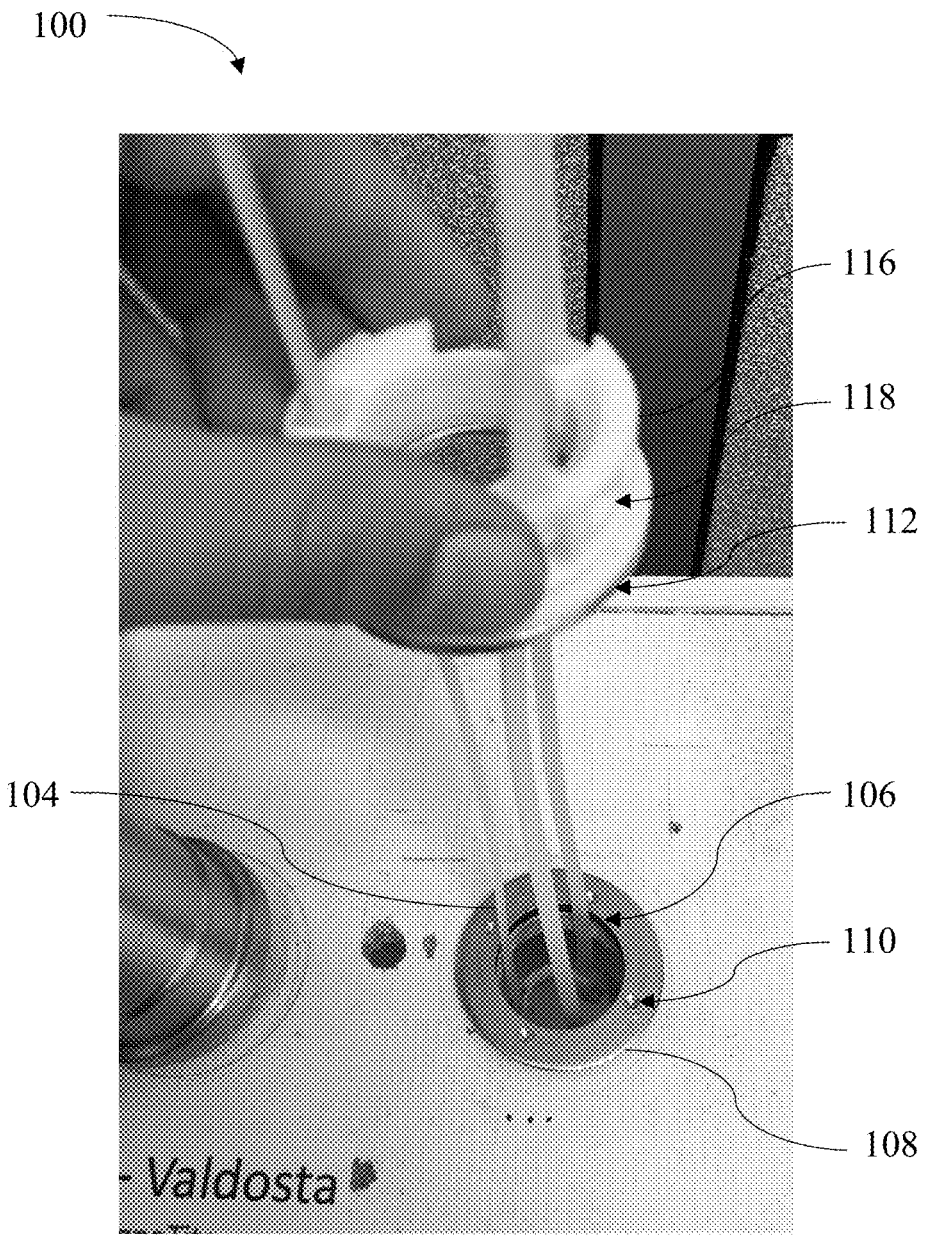
Figure 3C:
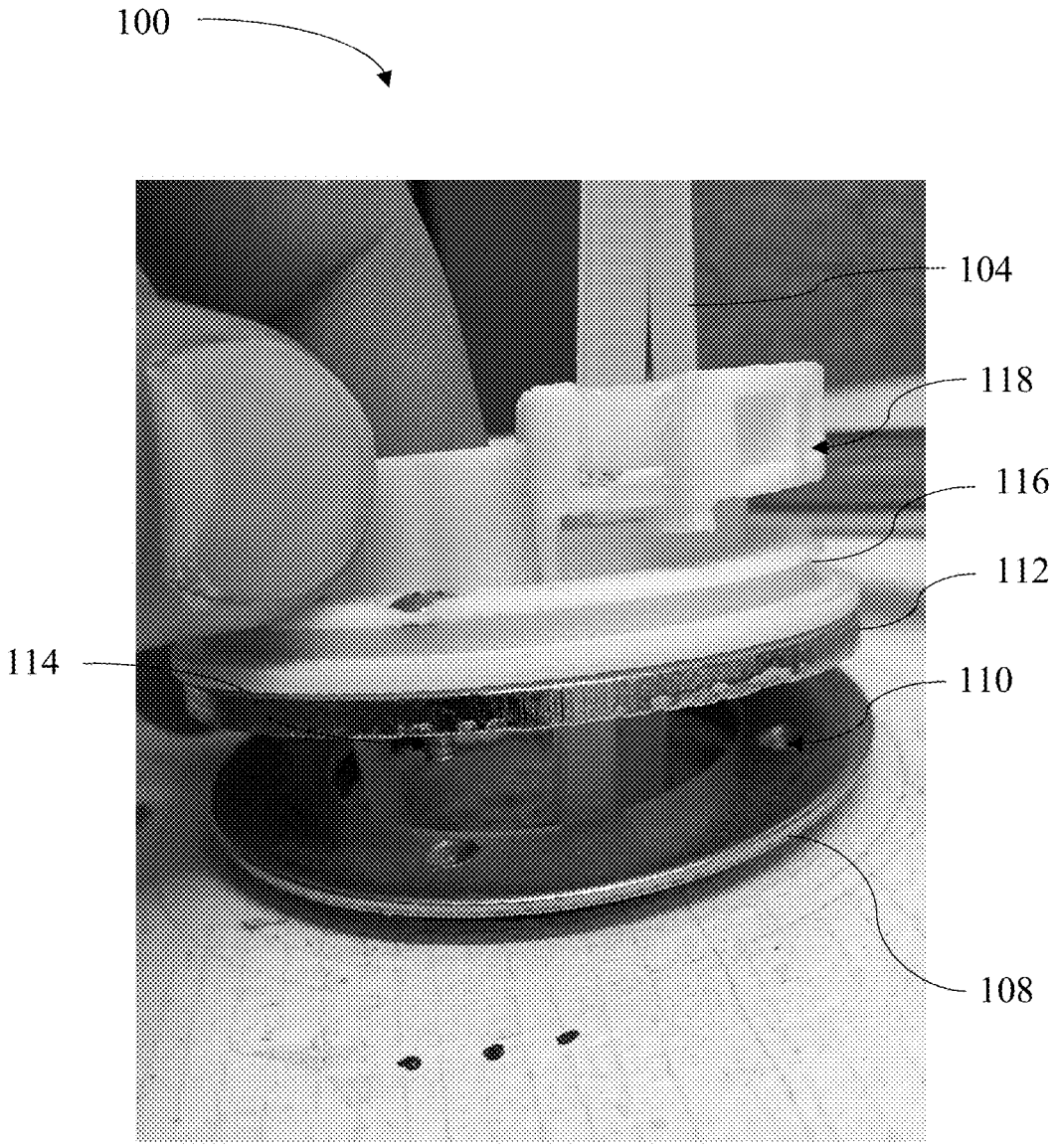

In various non-limiting examples, the locator washer 108 has a plurality of locator points 110. The plurality of locator points 110 are at least equivalent in number to the plurality of washer holes 120 and spaced to couple with the plurality of washer holes 120. FIG. 3C exemplifies how the screws 114 can be threaded through the plurality of collar holes 122 and the plurality of washer holes 120. After the screws 114 are inserted through the plurality of collar holes 122 and the plurality of washer hole 120, the screws 114 rest in the locator points 110 and are secured to the deck 400 to prevent the faucet installation assembly 110 from shifting after installation.

In various examples, the gasket 106 is shaped and sized to form a seal when the faucet installation assembly 100 elements are compressed together by the threading of the screws 114 and the installing of the faucet body 200 with the collar 116. FIGS. 3A-3C exemplify the positions of the gasket 106 relative to the rest of the embodiment during the process of installation of the faucet installation assembly 100.

Figure 4:
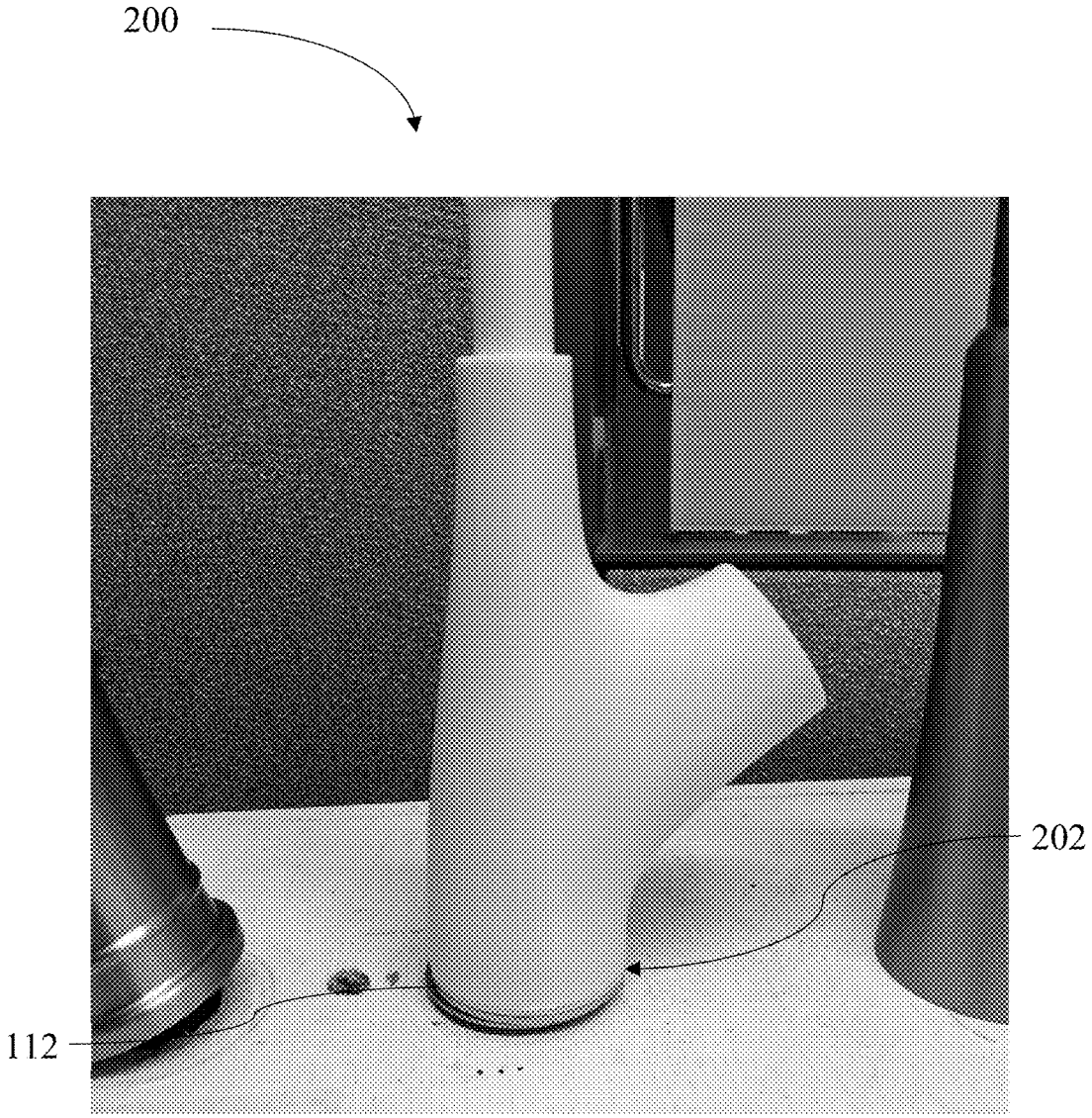
FIGS. 4 and 5 are perspective views of a faucet body installed on an example faucet installation assembly.
Figure 5:
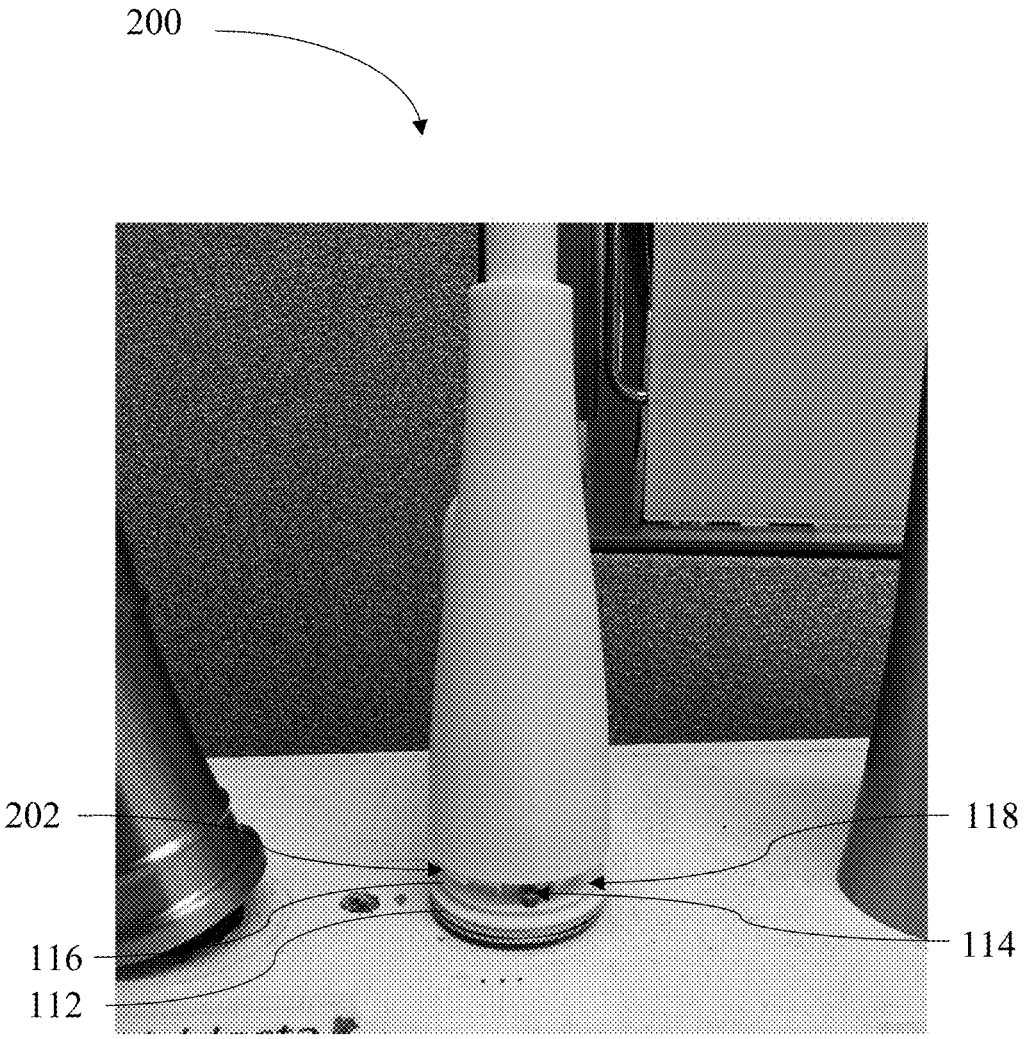

In various examples, the collar 116 has an interlocking attachment 118, such as, for example, external threads. The faucet body 200 having corresponding mating features (not shown) can be secured to the interlocking attachment 118 to complete installation by way of the base 202. One method of securing the interlocking attachment 118 to the base 202 is rotating the faucet body 200 about the interlocking attachment 118, such as for example, by a quarter turn, or more or less turns. FIG. 5 exemplifies such a method, wherein the interlocking attachment 118 secures the faucet body 200 to the faucet installation assembly. FIG. 4 exemplifies a completed attachment of the faucet installation assembly to the faucet body 200.

Figure 6:
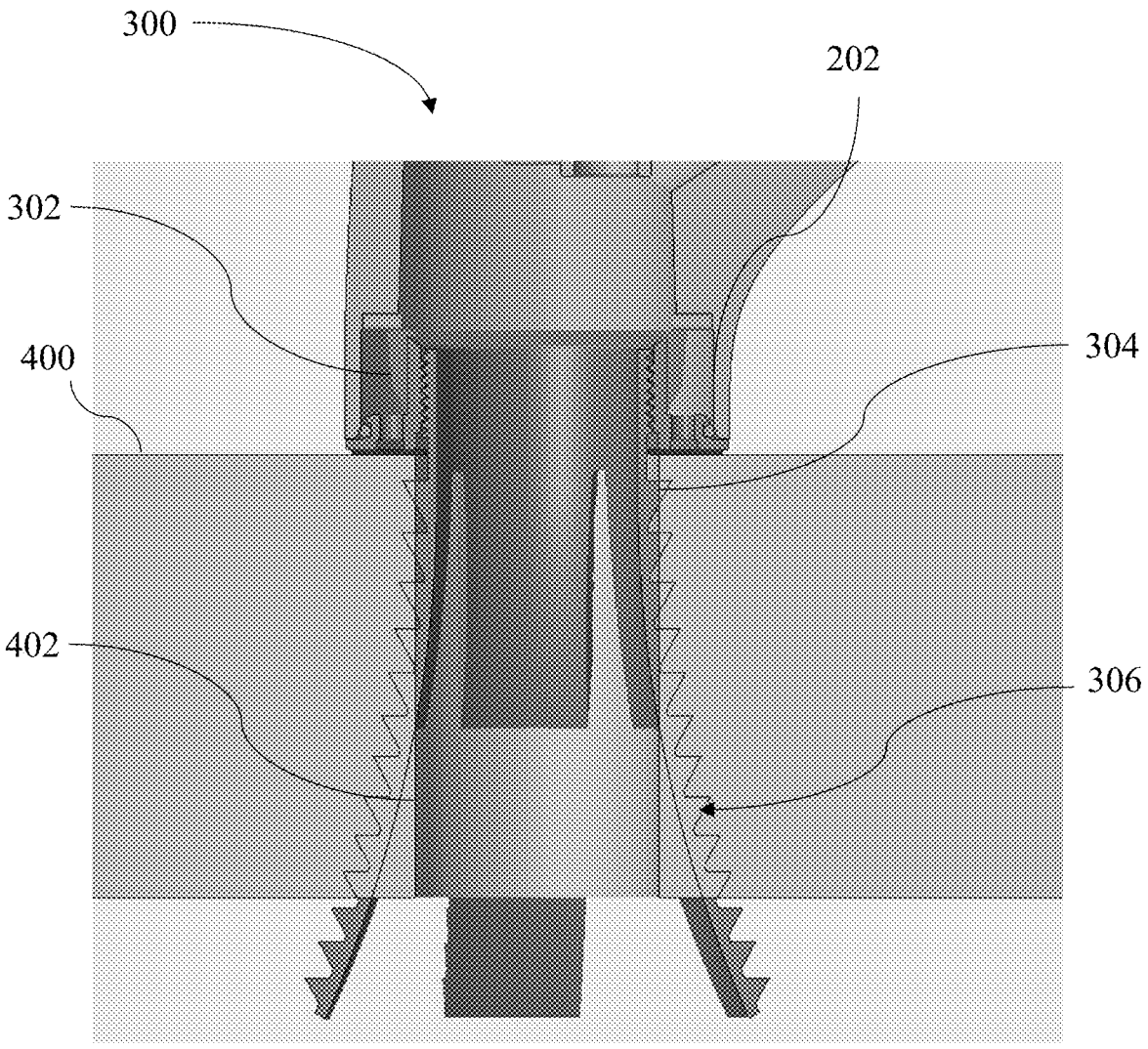
FIG. 6 is a side perspective view of another example of a faucet installation assembly in an installed position.

FIG. 6 illustrates another example of a faucet body 200 that can be installed into a desired location when used in conjunction with a shank faucet installation assembly 300. The faucet body 200 has a base component 202. The faucet body 200 can be installed with the faucet installation assembly 300 onto a deck 400 with an aperture 402.

More specifically, FIGS. 7A-7E illustrate an exemplary embodiment of a shank faucet installation assembly 300. This shank faucet assembly 300 can include at least a shank nut 302 and a plurality of shank stems 304 coupled at a first end forming a collar 303, each shank stem 304 having a free end extending radially and axially from the collar 303. The collar 303 can include threading 312 on an exterior side that is configured to threadingly engage threading 310 on an internal surface of the shank nut 302 to secure the shank nut 302 to the collar 303. In one example, shank faucet installation assembly 300 includes four stems 304; however, more or less shank stems can be contemplated. In one non-limiting example, shank stems 304 can have a length from about 3 to about 6 inches, or more specifically from about 4 to about 5 inches, or even more specifically, about 4.5 inches.

Each shank stem 304 can have structure defining a plurality of tabs or steps 306, either evenly or unevenly spaced. The plurality of shank stems 304 are long enough to emerge through the opposing side of the aperture 402, and adjusted until a bottom-side of the deck 400 seats on one of the steps 306 of each stem 304 and the collar 303 with threading 312 remains entirely above the deck 400. Each step 306 can define a right angle, or an acute angle. The steps 306 can be dimensions such that they are large enough to catch on the underside of the deck, and spaced enough such that the spacing between two adjacent steps allows the collar 303 to remain above the deck 400.

As mentioned above, the shank nut 302 includes threading 310 on an internal surface thereof, and includes an interlocking mechanism 308, such as a plurality of snap fit tabs, on an exterior surface, which will be described in more detail below. The shank nut 302 also includes a groove on the exterior surface, in which a rubber gasket or O-ring 314 can be inserted for forming a seal with the faucet body 200. The shank nut 302 can be low-profile so that it can fit within a variety of faucet bodies 200.

Figure 7A:
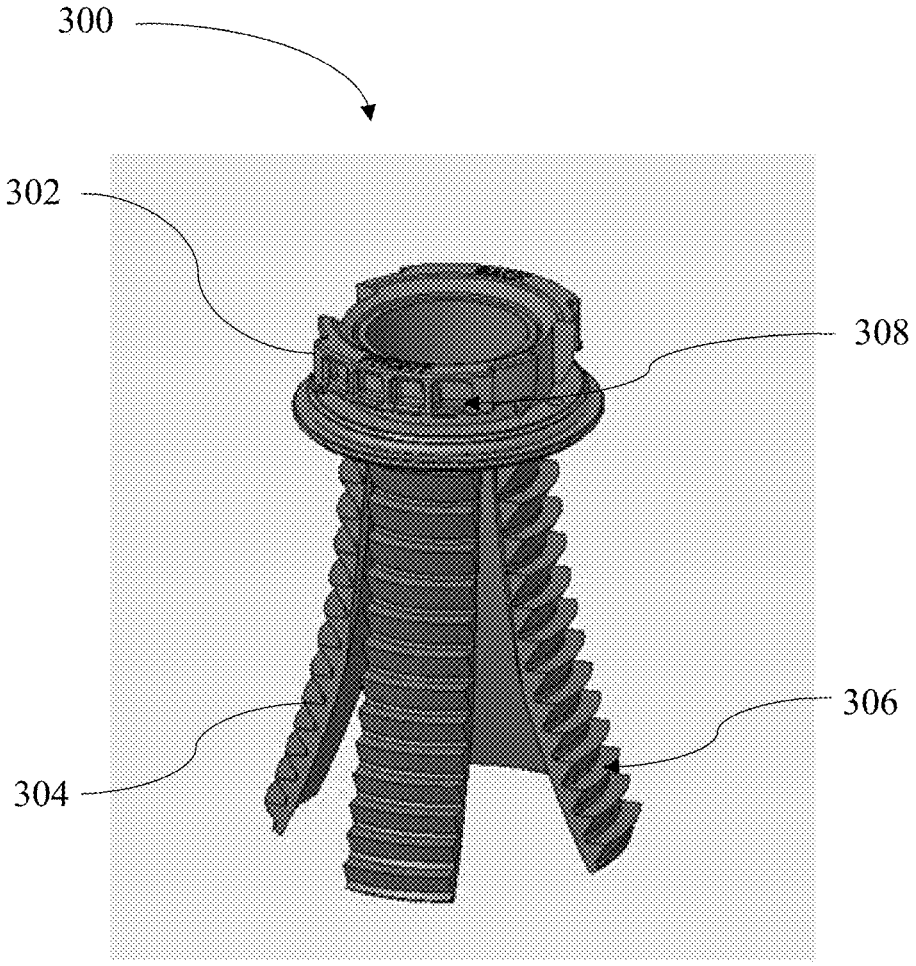
FIGS. 7A-7E are a perspective views of an example of a faucet installation assembly in various installation positions.
Figure 7B:
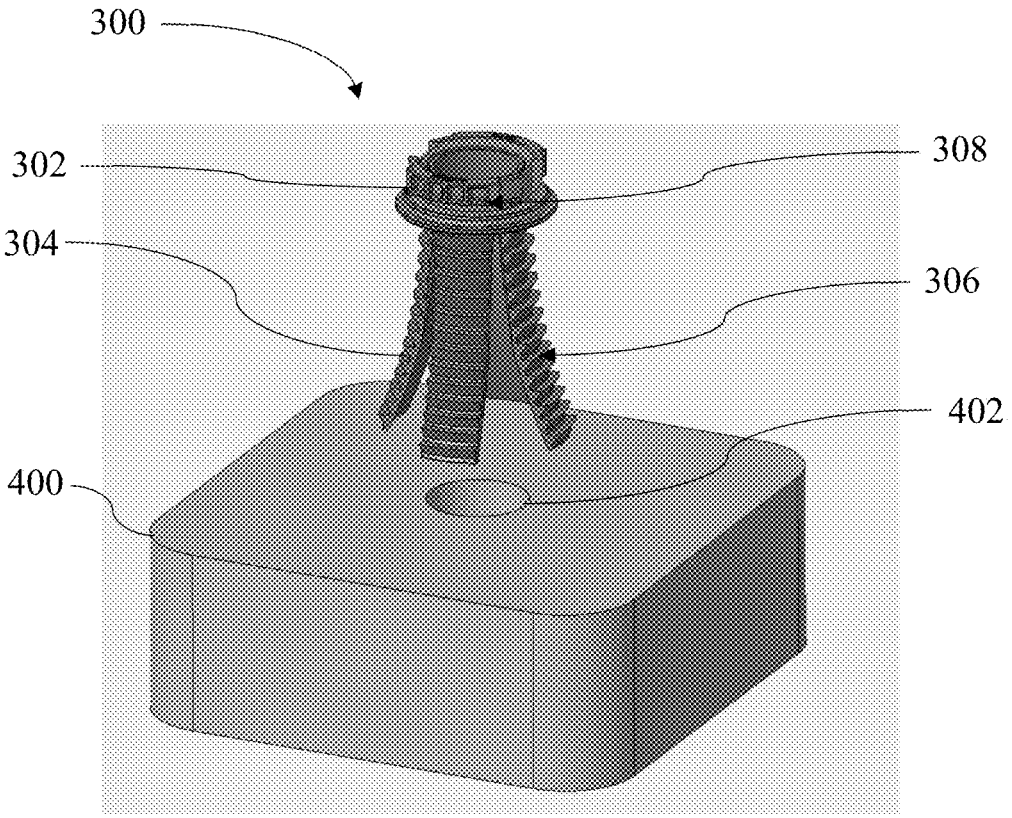
Figure 7C:
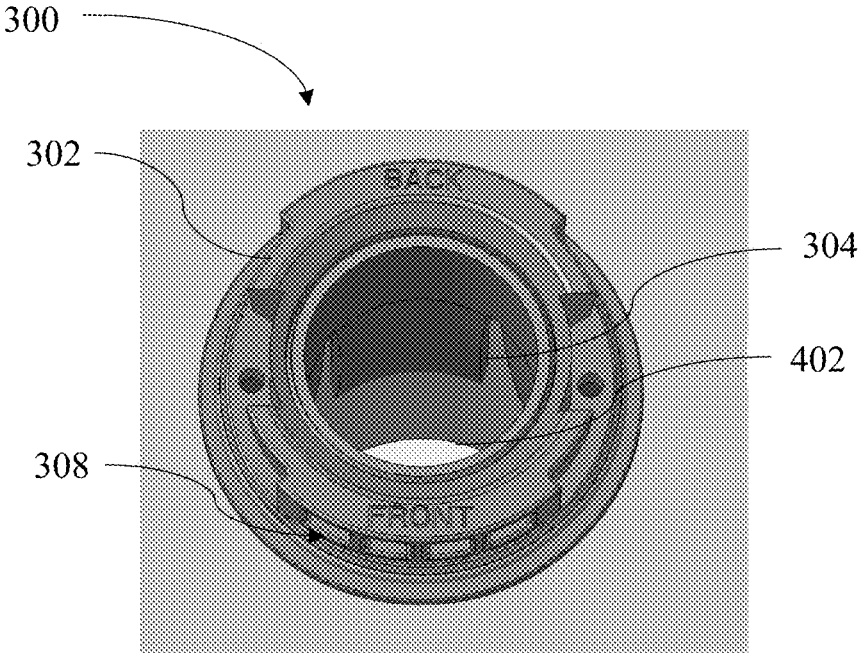
Figure 7D:
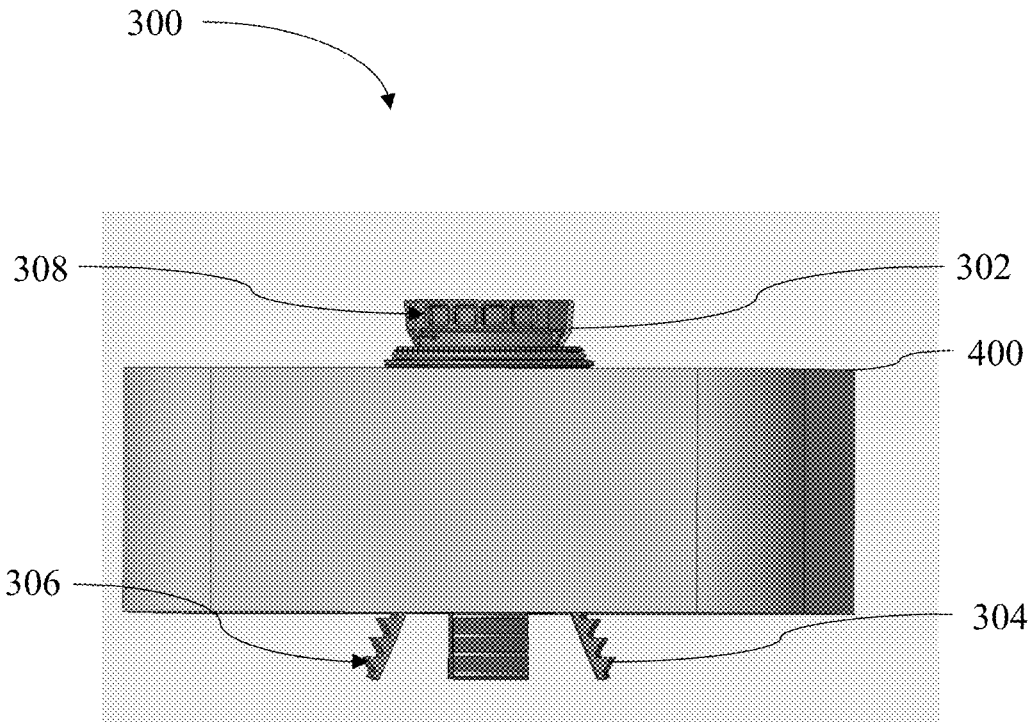

According to an example installation, and referring to FIG. 7B, the shank faucet installation assembly 300 can be inserted into the aperture 402 of the deck 400 by pinching the plurality of shank stems 304. Exemplified in FIG. 7D, as the plurality of shank stems 304 emerge through the aperture 402, the shank stems 304 expand outwards and the multitude of steps 306 overlap with the underside of the aperture 402, preventing the shank faucet assembly from reversing back through the aperture 402.

Figure 7E:
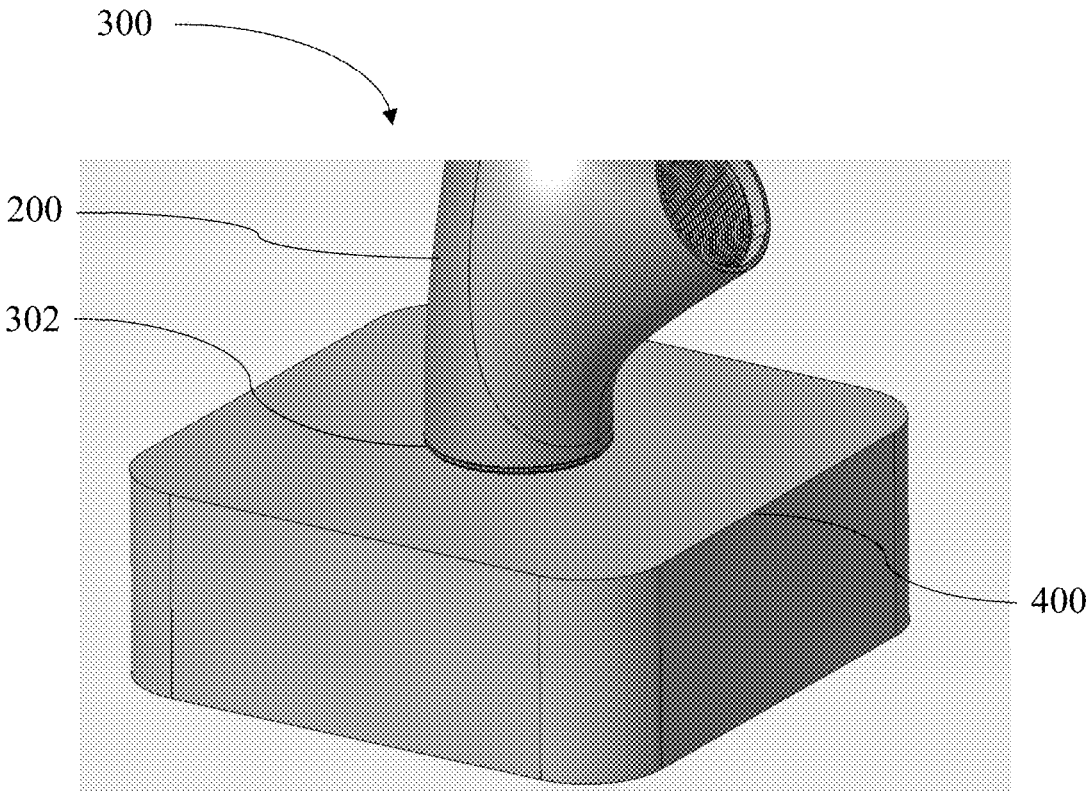

Similar to the faucet installation assembly 100 exemplified in FIG. 1, the shank faucet installation assembly 300 can be affixed to the faucet body 200. Exemplified in FIG. 7D, when the shank faucet installation assembly 300 is fully inserted through the aperture 402, the shank nut 302 is flush with the deck 400. Exemplified in FIG. 7C, the shank nut 302 has a shank nut interlocking mechanism 308 that fits with the base 202 of the faucet body 200 to affix the faucet body 200 to the deck 400 (depicted in FIG. 6). Optionally, the shank nut 302 can include indicators or labels, such as "Front" and "Back" indicators, for aiding the positioning of the faucet body 200 thereon. One exemplary method of fitting the shank nut interlocking mechanism 308 with the base 202 is a snap-fit method. In another example, the faucet body 202 can be affixed to the shank nut 302 by rotating to engage corresponding threads on the shank nut 302 to threads within the faucet body 202. FIG. 7E exemplifies the finished installation with the faucet body 202 affixed to the shank faucet installation assembly 300.

Figure 8:
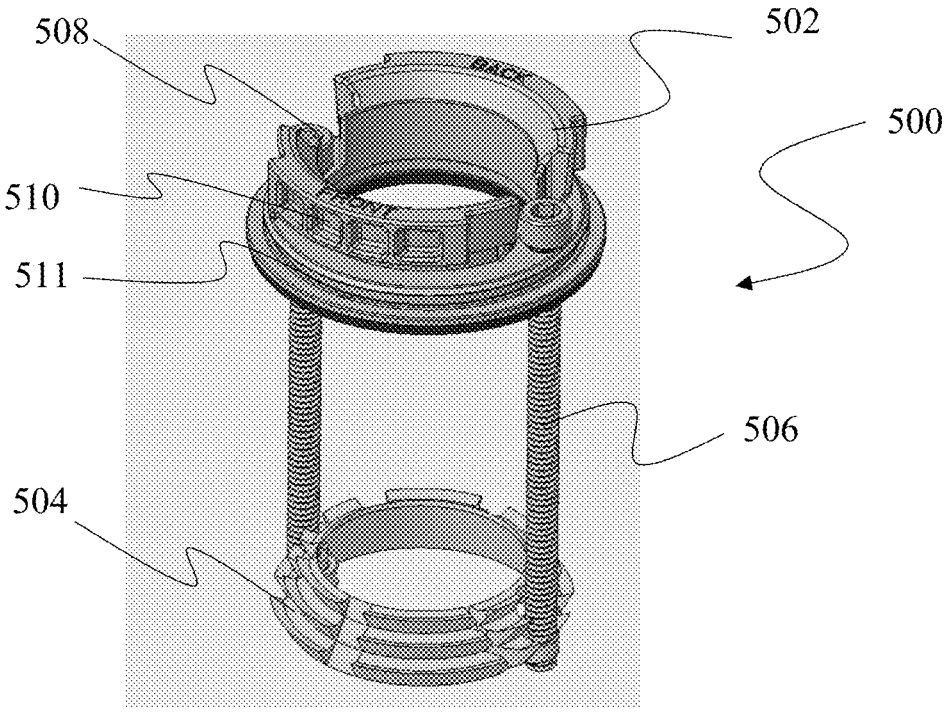
FIG. 8 is a perspective view of another example of a faucet installation assembly.
Figure 9:
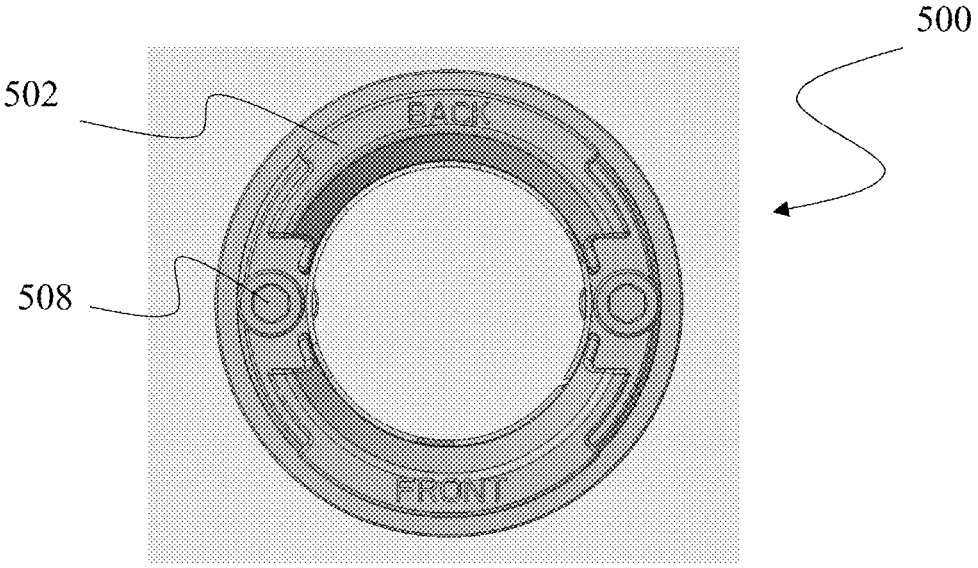
FIG. 9 is a top view of an example of a collar and fasteners of the faucet installation assembly of FIG. 8.
Figure 10:
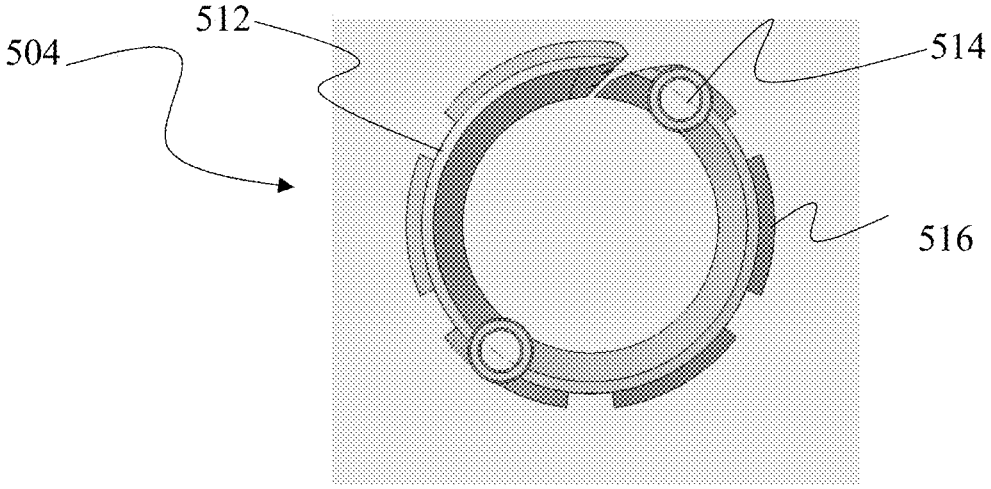
FIG. 10 is a top view of an example of an anchor member of the faucet installation assembly of FIG. 8.

Referring to FIGS. 8-10, another example of a faucet body 500 is illustrated. Faucet body can include, for example, a collar 502, an anchor 504, and a plurality of rigid fasteners 506 for securing the collar 502 to the anchor 504. In a non-limiting example, fasteners 506 can comprise machine screw fasteners with an external threading, and a screw head 508. Referring to FIG. 9, collar 502 can be ring-shaped, with an opening originating in the center of each component; however other shapes can be considered. In embodiments, the collar 502 can be similar to the collar 116, and can further include a locator/locker washer (not shown), and a threaded washer (not shown), or can be similar to the shank nut 302, and can include a plurality of snap fit tabs 510 (FIG. 8), on an exterior surface and a groove 511 for receiving a gasket therein. The collar 502 includes apertures defined therein for receiving an elongated portion of the fastener 506 therethrough. The collar 502 can optionally include indicators or labels, such as "Front" and "Back" indicators, for aiding the positioning of a faucet body thereon.

Referring to FIG. 10, the anchor 504 is similar to the anchor 116 of the faucet assembly 100, and is relatively deformable. The anchor 504 can generally include a circular or ring-shaped sidewall 512 and apertures 514 defined therein for receiving the elongated portion of the fastener 506 therethrough. The anchor 504 can also include a plurality of annular flanges 516 having different diameters to accommodate differently sized apertures in a deck.

In use, fasteners 506 are inserted through the apertures of the collar 502 and the apertures 514 of the anchor 504. The anchor 504 is deformed, such as by pinching or squeezing, and inserted through an aperture in the deck. The collar 502 is pulled up on until the corresponding flange 516 is in contact with an underside of the deck. Fasteners 506 are rotated via a screwdriver or hex key, to move the collar 502 towards the anchor 504 until a bottom side of the collar 502 is in contact with a top side of the deck. The elongated portions of the fasteners extend below the anchor 504 underneath the deck. A faucet head (not shown) is then coupled to the collar 502 as described with respect to the other embodiments.

The faucet installation assemblies disclosed herein include flexible stems that can be movably aligned with an aperture in order to install a faucet body onto a deck. This can allow for increased efficiency in faucet installation, with fewer required elements, and with a reduced need to access below the deck for installation.

As utilized herein, the terms "approximately," "about," substantially," and similar terms are intended to have a broad meaning in harmony with the common and accepted usage by those of ordinary skill in the art to which the subject matter of this disclosure pertains. It should be understood by those of ordinary skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in appended.

It should be noted that the term "exemplary" as used herein to describe various examples is intended to indicate that such examples are possible examples, representations, and/or illustrations of possible examples (an such term is not intended to denote that such examples are necessarily extraordinary or superlative examples).

The terms "coupled", "connected", and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in FIGURES. It should be noted that the orientation of various elements may differ according to other examples, and that such variations are intended to be encompasses by the present disclosure.

It is important to note that the construction and arrangement of the assembly as shown in examples is illustrative only. Although only a few examples have been described in detail in this disclosure, those skilled in the art who review this disclosure will readily appreciate that many modifications are possible (e.g., variations in sizes, dimensions, structures, shapes and proportions of the various elements, values or parameters, mounting arrangements, use of materials colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions and arrangement of the various exemplary examples without departing from the scope of the present invention. For example, any element disclosed in one embodiment may be incorporated or utilized with any other embodiment disclosed herein.

What is claimed is:

1. A faucet installation assembly for coupling a faucet body to a surface, the faucet installation assembly comprising:

an anchoring component including an anchor and a plurality of elongated members extending axially from the anchor, the anchor including a plurality of annular flanges having different diameters to accommodate differently sized apertures in the surface, the anchor configured to be seated on an underside of the surface and fit at least partially within an aperture in the surface, and the elongated members configured to extend through the aperture; and a collar coupled to the elongated members configured to be secured to a top side of the surface for coupling the faucet body to the surface.

2. The faucet installation assembly of claim 1, wherein the anchor is configured to be seated on the underside of the surface through manual compression and insertion into the aperture.

3. The faucet installation assembly of claim 2, wherein the collar comprises at least one opening configured to receive at least one fastening member to securely fasten the faucet installation assembly to the aperture.

4. The faucet installation assembly of claim 3, further comprising:

a gasket configured to sit on a top portion of the anchor and form a seal between the faucet installation assembly and the aperture whenever the at least one fastening member is coupled to the at least one opening of the collar.

5. The faucet installation assembly of claim 4, further comprising:

a locator washer configured to couple to the plurality of elongated members and sit on a top portion of the gasket, the locator washer comprising at least one locator point for receiving the at least one fastening member.

6. The faucet installation assembly of claim 5, further comprising:

a threaded washer configured to be seated between the collar and the locator washer, the threaded washer comprising at least one opening for receiving the at least one fastening member.

7. The faucet installation assembly of claim 1, wherein the collar comprises an interlocking attachment configured to couple to corresponding mating features of the faucet to securely fasten the collar to the faucet.

8. The faucet installation assembly of claim 7, wherein the interlocking attachment comprises threads configured to threadingly engage a threaded portion of the faucet.

9. The faucet installation assembly of claim 1, wherein the elongated members comprise flexible stems.

10. The faucet installation assembly of claim 1, wherein the elongated members comprise threaded fasteners.

* * * * *